United States Patent [19]

Louden

[11] 4,227,958

[45] Oct. 14, 1980

[54] APPARATUS FOR APPLYING AN END CAP TO A CLOTH BOARD REEL

[75] Inventor: Samuel Louden, Cinnaminson, N.J.

[73] Assignee: National Tube and Reel Corporation, Delran, N.J.

[21] Appl. No.: 42,829

[22] Filed: May 29, 1979

[51] Int. Cl.[2] ..... B29C 17/00

[52] U.S. Cl. ..... 156/443; 156/216; 156/486; 156/492

[58] Field of Search ..... 156/196, 201, 202, 216, 156/226–227, 443, 463, 464, 459, 470, 485, 476–482, 486–492

[56] References Cited

U.S. PATENT DOCUMENTS

| | | | |
|---|---|---|---|
| 3,190,783 | 6/1965 | Tarnok | 156/489 |
| 3,535,189 | 10/1970 | Hall et al. | 156/486 |
| 3,756,894 | 9/1973 | Shugart | 156/443 |
| 3,943,030 | 3/1976 | Olsen | 156/486 X |
| 4,039,367 | 1/1977 | Warshaw et al. | 156/486 X |

*Primary Examiner*—David A. Simmons
*Attorney, Agent, or Firm*—Michael F. Petock

[57] ABSTRACT

Apparatus is provided for applying an end cap to a cloth board reel automatically. The end cap has a front wall and a pair of side walls. One of the side walls is provided with an extension at each end which wraps around the longitudinal ends of the reel. The machine applies the long side wall to the reel, folds over the front wall, and wraps the extensions of the side wall around the longitudinal edges of the reel. The remaining side wall is then folded over the broad side of the reel and the extensions which have been wrapped around.

17 Claims, 14 Drawing Figures

APPARATUS FOR APPLYING AN END CAP TO A CLOTH BOARD REEL

BACKGROUND OF THE INVENTION

The present invention relates to an apparatus for applying an end cap to a cloth board reel. More particularly, the present invention relates to an apparatus for automatically applying an end cap having a front wall and a pair of side walls wherein the side walls are automatically folded over the broad sides of the reel and extensions on one of the side walls are wrapped around the longitudinal edge of the reel.

The present invention is directed to an apparatus for automatically applying an end cap such as those described in the co-pending application of the applicant herein entitled *END CAP FOR CLOTH REEL,* Ser. No. 6,630, filed Jan. 26, 1979, and assigned to the assignee herein.

SUMMARY OF THE INVENTION

The present invention is directed to an apparatus for automatically applying an end cap as described in applicant's co-pending application, supra.

In accordance with the present invention, the end caps to be applied are comprised of a front wall which is bonded to the end of the reel and a pair of articulated side walls which are to be bent over and bonded to the broad surface of the cloth board reel. One of the side walls is provided with extensions which wrap around the longitudinal edges of the reel. The end caps may be provided with articulated end walls which are folded along the longitudinal edges prior to the wrapping of the extensions around the longitudinal edges.

In accordance with the present invention, a reel is moved through the apparatus by a transport means. The machine in accordance with the present invention simultaneously applies an end cap to each end of a reel passing through the machine. The end cap is applied to each end of the reel in an identical manner, and therefore, only application of an end cap to one end of the reel will be discussed for purposes of clarity.

As the reel is transported through the apparatus, hot melt adhesive is sprayed around the circumference of the end of the reel. The reel is then transported to the next station where the side wall having extensions is applied to one of the broad surfaces of the reel. The front wall is then folded over the end of the reel. If the end cap is provided with articulated end walls, these are then tucked in along the longitudinal edges of the reel. The reel is then transported to the next station wherein the extensions of the side wall are automatically wrapped around the longitudinal edges of the reel.

This wrap around station is comprised of a frame driven towards and away from the broad side of the reel on which the side wall with extensions has been applied. The frame is provided with a pair of spring bias roller arms which are maintained by the spring bias against a stop when the roller is not in contact with the reel. The lower end of the roller arms, or the end closest to the reel, is provided with a roller plate having three rollers arranged in an arcuate path corresponding substantially to the shape of the longitudinal edge of the reel. The roller plate is pivotally mounted to the lower end of the roller arm and spring biased against the stop. As the frame moves downwardly or toward the reel, the roller plate rotates on its pivot point allowing the three rollers on the roller plate to wrap the extension of the side wall of the end cap around the longitudinal edge of the reel. The three rollers on the roller plate allow the extension to be wrapped around the longitudinal edge uniformly and prevent the roller from becoming locked on the reel. As the roller plate with the rollers thereon wraps the extension around the edge of the reel, the roller arm moves outwardly against the spring bias of the roller arm.

After the extension of the side wall is wrapped around the longitudinal edge of the reel, the reel is transported past a sloped wheel which folds the other side wall onto the other broad surface of the reel and over the extensions.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1A:
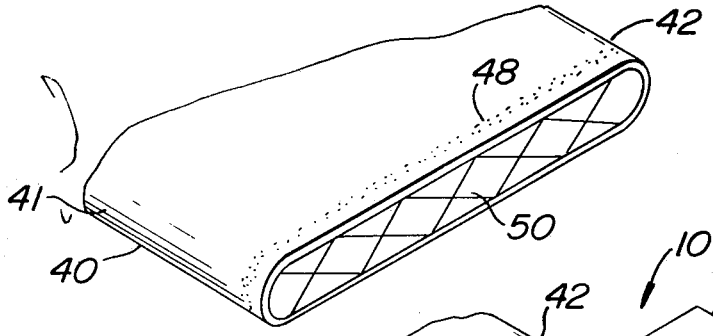
FIG. 1(A) is a view in perspective of one end of a reel which an end cap is to be applied by the apparatus of the present invention.
Figure 1B:
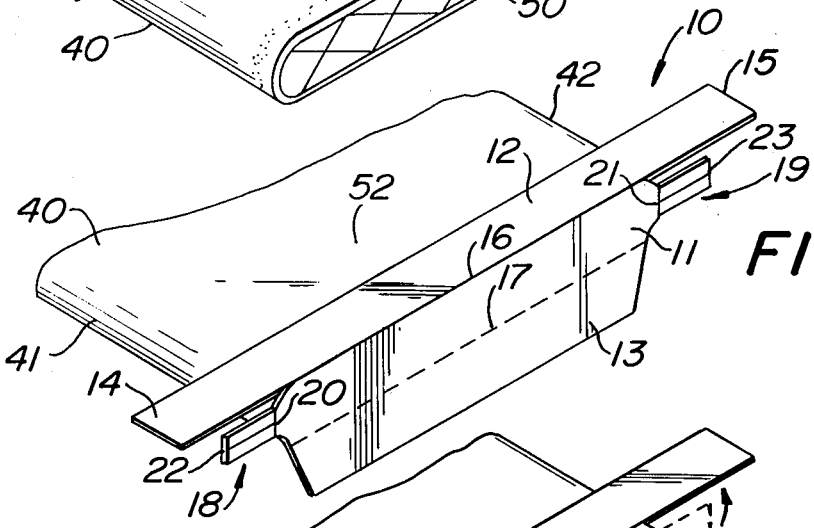
FIGS. 1(B) through 1(E) are views in perspective illustrating a sequence of steps in applying an end cap to a reel in accordance with the present invention.

Referring now to the drawings in detail wherein like numerals indicate like elements, there is shown in FIG. 1B an end cap 10 which is to be applied to the end of a cloth board reel 40. The end caps 10 applied to the cloth board reel 40 may be the same as those described in the co-pending patent application Ser. No. 6,630 of the applicant herein which was referred to above. The end caps 10 may be die cut from card board blanks and are fed in the machine flat. The end cap 10 is provided with a front wall 11 and a pair of articulated side walls 12 and 13 integral therewith. FIG. 1B shows the end cap folded along line 16 which joins front wall 11 and side wall 12. Dotted line 17 in FIG. 1B indicates a score line for ease in folding side wall 13 with respect to front wall 11. End cap 10 may preferably be scored along line 16 to aid in the folding along line 16. Side wall 12 is provided with extensins 14 and 15 which are subsequently wrapped around the longitudinal ends 41 and 42 of cloth board reel 40.

Front wall 11 of end cap 10 may be provided with a pair of articulated end walls 18 and 19 which extend laterally from the ends of front wall 11. These are connected to the front wall and are provided with score lines 20 and 21 for ease in bending when the end cap is applied to the reel. End walls 18 and 19 may be die cut along lines 22 and 23 so that the end walls may form a closer fit to the arcuate longitudinal edges 41 and 42 of the reel when the end cap is applied to the reel. However, it is understood that end walls 18 and 19 are not necessary and may be eliminated. However, end walls 18 and 19 are preferrably provided to provide smoother surfaces at points 44 and 46 where the ends of the longitudinal surfaces meet the front wall 11.

Referring now to FIG. 1A, there is shown a cloth board 40 having longitudinal edges 41 and 42. Longitudinal edges 41 and 42 are arcuate as may be seen from the end view of FIG. 1A. The cloth board reel may be made of cardboard with a corrugated cardboard inside support system, for example see U.S. Pat. No. 3,967,800, which is assigned to the assignee herein.

The application of the end cap 10 to cloth board reel 40 will be described herein briefly to provide an overview of the steps which are carried out automatically by the apparatus disclosed herein. In the actual manufacture of cloth board reels, an end cap is applied to each end of cloth board reel 40. However, the application of the end cap to each end of the reel is identical, and only one end will be illustrated.

As the first step in applying end cap 10 to reel 40, an adhesive, preferrably a hot melt adhesive is applied at 48 on the periphery of the reel near the end. The hot melt glue is also sprayed onto the end face 50 of reel 40. The hot melt adhesive may be any suitable well known hot melt adhesive. Such hot melt adhesives are well known in the industry and comprise a solid, thermoplastic material which quickly melts upon heating and sets to a firm bond on cooling. The hot melt type of adhesive offers very fast bonding which enables rapid machine operation. Hot melt adhesives may be made of various thermoplastic materials such as polyethylene, polyvinyl acetate, polyamides, hydrocarbon resins, as well as natural asphalt, bitumens, resinous materials and waxes.

The next step in the application of end cap 10 to cloth board reel 40 involves the applying of side wall 12 onto the broad surface 52 of reel 40. Side wall 12 is the wall provided with side wall extensions 14 and 15 which are eventually wrapped around the longitudinal edges of the reel. For the purposes of description, it will be assumed that side wall 12 is applied to the upper broad surface 52 of reel 40 as shown in FIG. 1B, although it is understood that this could be applied to either broad surface, the upper or the lower surface. Once side wall 12 is bonded to the upper broad surface 52, front wall 11 is folded over onto end face 50, to which hot melt adhesive had been previously applied.

Figure 1C:
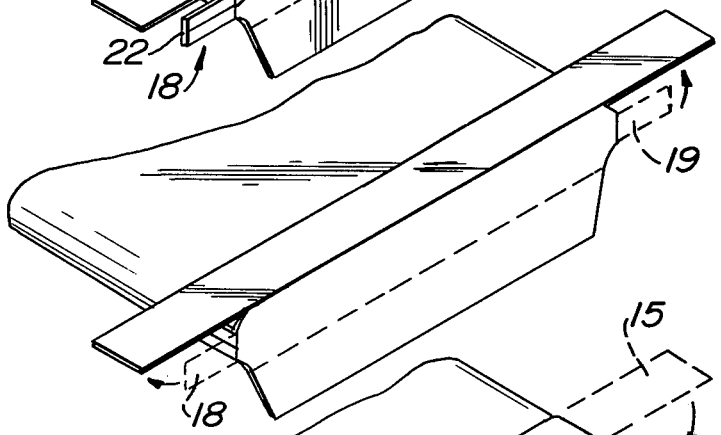
Figure 1D:
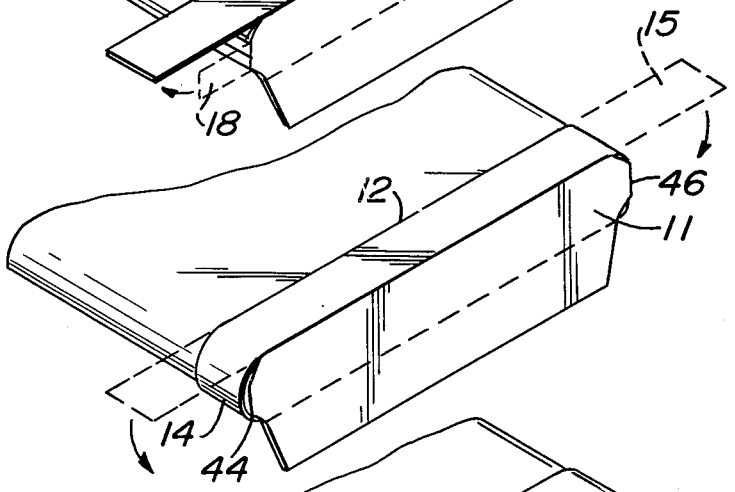

The next step in the application of the end cap is to fold over end walls 18 and 19 onto the longitudinal surfaces 41 and 42, respectively as shown in FIG. 1C. Side wall extensions 14 and 15 are then wrapped around the longitudinal edges over the end walls as shown in FIG. 1D. As discussed above, in certain applications end walls 18 and 19 may not be used.

As the last step, lower side wall 13 is folded up onto the bottom broad surface of reel 40 covering the extreme ends of side wall extensions 14 and 15.

Figure 2:
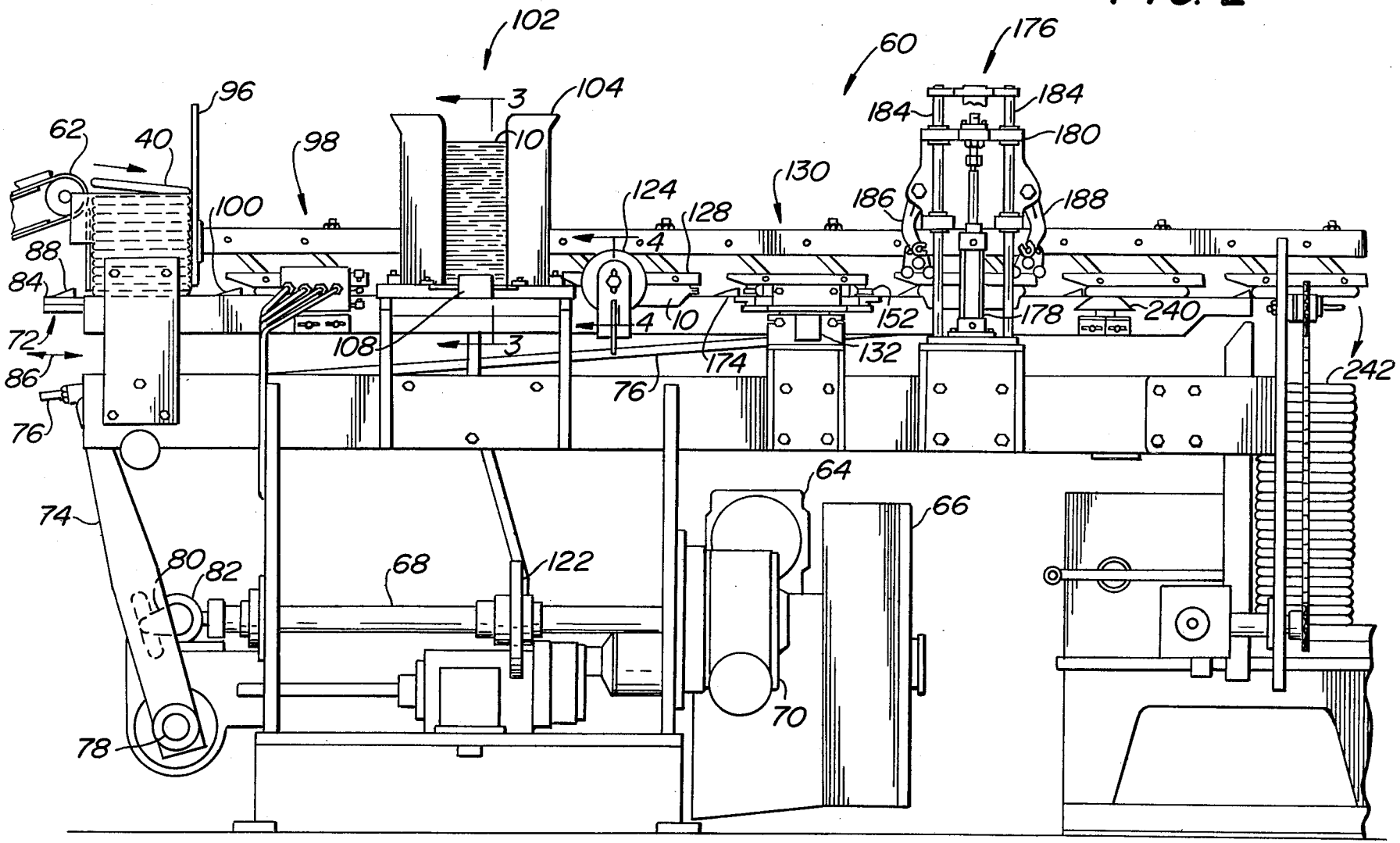
FIG. 2 is a side elevation view of an apparatus in accordance with the present invention for applying end caps to reels.

Referring now to FIG. 2, there is shown a side elevation view of an apparatus 60 for applying end caps 10 to cloth board reels 40. Cloth board reels 40 may be of the type more particularly described in U.S. Pat. No. 3,967,800, assigned to the assignee hereof. Alternatively, cloth board reels 40 may be of the type described in U.S. Pat. No. 3,286,828 made by an apparatus as described in U.S. Pat. No. 3,510,383, both of said patents being assigned to the assignee hereof. The cloth board reels 40 may be delivered to apparatus 60 by means of conveyor 62.

Apparatus 60 is driven by motor 64, which may preferrably be an electric motor controlled by motor control circuitry contained in cabinets 66. Motor 64 drives cam shaft 68 through a right angle worm gear drive box 70.

Reel transport means 72 is driven by drive arm 74 through adjustable connecting rod 76. Drive arm 74 is pivoted at 78 and driven by crank 80, shown partially in dotted lines. Crank 80 is driven by bevel gear drive 82 from cam shaft 68.

Figure 5:
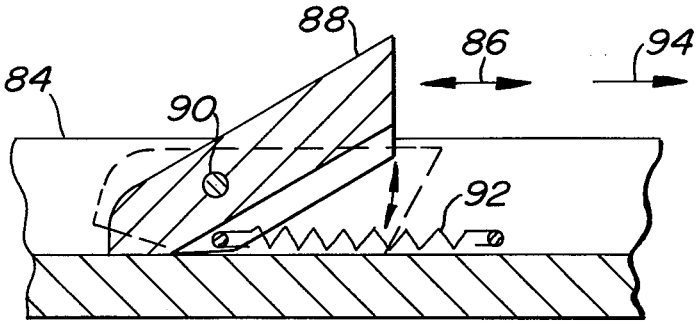
FIG. 5 is a cross-sectional view taken along line 5—5 of FIG. 4 illustrating the pusher mechanism of the transport means of the apparatus in accordance with the present invention.

Reel transport means 72 is comprised of a reciprocating beam 84 sometimes referred to as a walking beam or stepping beam. Beam 84 moves forward and backward in the directions of double-headed arrow 86 sufficient to move reels 40 from one station to another. Beam 84 is provided with spring loaded pushers 88 for pushing the reels 40 as shown in FIG. 2 and as shown in greater detail in FIG. 5. There is a pusher 88 to move a reel from each machine station to the next. As shown more clearly in FIG. 5, pusher arm 88 is pivoted at point 90 and is spring biased by means of spring 92 in the upward position out of the plane of beam 84. Spring loaded pusher 88 therefore pushes reel 40 in the direction of arrow 94, but is able to be retracted back into the plane of beam 84 to enable beam 84 to return to push the next reel without carrying a reel backwards. Preferrably, there are two spring loaded pushers at each location located near the two ends of the reel, but sufficiently inward of the ends so as not to interfere with the application of end caps 10.

The reels 40 are stacked from conveyor 62 at the first station in reel hopper 96. From reel hopper 96, reels 40 are moved by means of pusher 88 to hot melt adhesive application station 98. At station 98, hot melt adhesive is sprayed around the periphery near each end of the reel and to each end face of the reel 50 as previously described with respect to FIG. 1A. Hot melt adhesive spray applicators are known in the art and need not be described here in detail.

Figure 3:
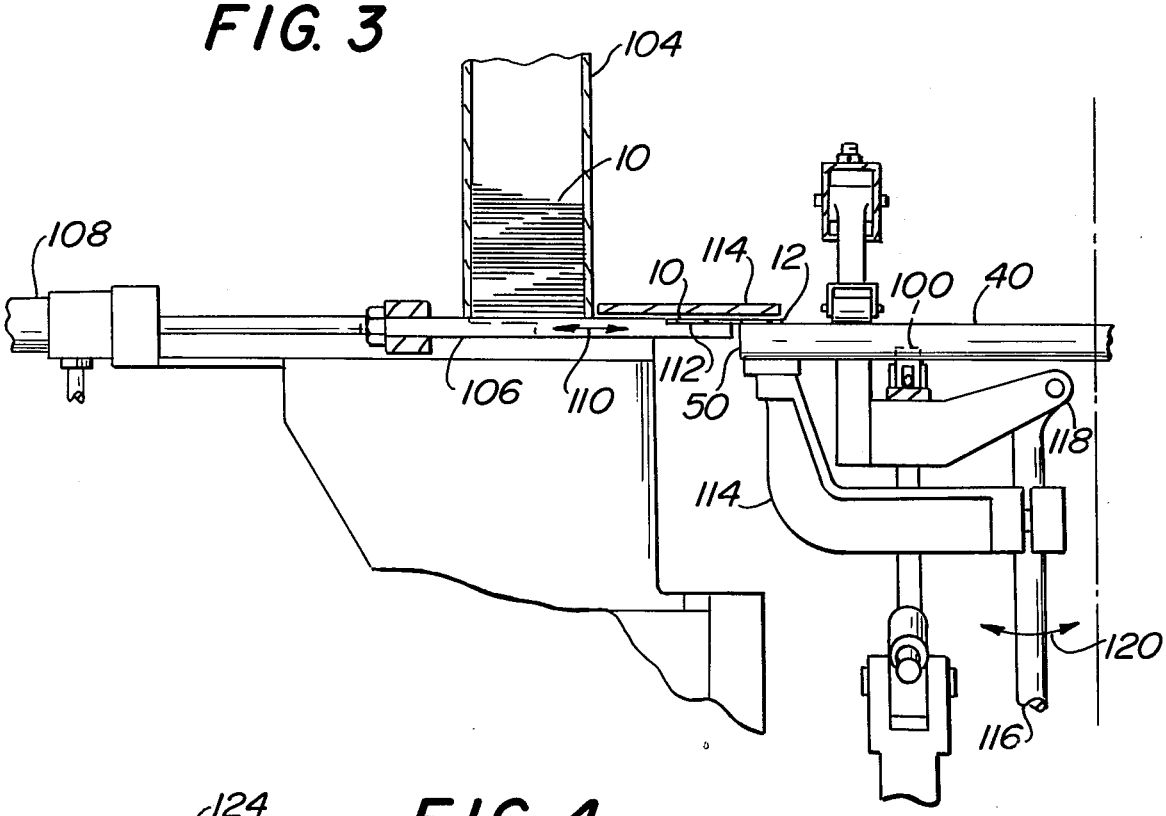
FIG. 3 is a cross-sectional view taken along line 3—3 of FIG. 2 illustrating the first step of applying the end cap.

Once the hot melt adhesive is applied at station 98, the reel 40 with hot melt adhesive applied thereto is moved by spring loaded pusher 100 on beam 84 to end cap storage and application station 102. End caps 10 are stored in end cap hopper 104. End caps 10 are stored in end cap hopper in a flat condition in the same form as when they are originally die stamped out of a flat piece of material. In other words, the end caps 10 are flat and not folded along any of the score lines. Reference should be made to FIGS. 2 and 3 in order to obtain a better understanding of end cap storage and application station 102.

End caps 10 are fed from the bottom of hopper 104 by means of a slotted feed arm 106 which is driven by pneumatic cylinder 108. Slotted feed arm 106 reciprocates in the directions of double headed arrow 110. Slotted feed arm 106 is provided with slot 112. Slot 112 is of a depth selected to remove only a single end cap from the bottom of hopper 104. Feed arm 106 applies the end cap to reel 10 so that side wall 12 is applied to the upper broad surface of cloth board reel 40, to which hot melt adhesive 48 has been previously applied at hot melt adhesive application station 98. Feed arm 106 actually delivers end cap 10 slightly above the upper surface of reel 40 to prevent any possible problem of end cap 10 contacting the face 50 of cloth board reel 40. Reel 40 is raised to come in contact with end cap 10 wherein end cap 10 is pressed against plate 114 by means of lift arm 114. Lift arm 114 is caused to move the end of reel 40 in an upward direction by reason of rod 116 being pivoted at point 118 and moved in the directions of double headed arrow 120 through cam 122 (shown in FIG. 2) mounted on cam shaft 68. The action of rod 116 pivoting on point 118 in the direction of double headed arrow 120 causes lift arm 114 to raise the ends of cloth board reel 40 into contact with side wall 12 of end cap 10, thereby causing the two to be bonded together by the rapid bonding action of hot melt adhesive.

Figure 4:
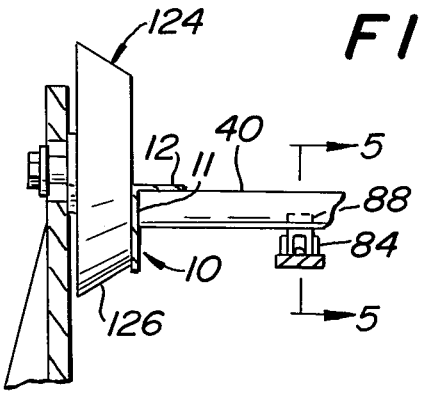
FIG. 4 is a cross-sectional view taken along line 4—4 of FIG. 1 illustratng the wheel for folding over the front wall of the end cap.

Reel 40 in the next step is then transported past taper roller 124 a cross-sectional view of which is shown in FIG. 4. Taper roller 124 is an idler roller having a circumference which tapers outwardly as shown in FIG. 4. As cloth board reel 40 with end cap 10 already attached thereto along side wall 12 is moved past taper roller 124, front wall 11 is folded over against end face 50 of cloth board reel 40 as shown in FIG. 1B. The hot melt adhesive previously applied to end face 50 at hot melt adhesive application station 98 rapidly bonds wall 11 of end cap 10 to end face 50 of cloth board reel 40. The tapered surface 126 of taper roller 124 is selected to provide an action folding over front wall 11 with a minimum of a resistance to end cap 10. Pressure may be maintained on side wall 12 to maintain it in contact with cloth board reel 40 by means of structure 128.

Figure 6:
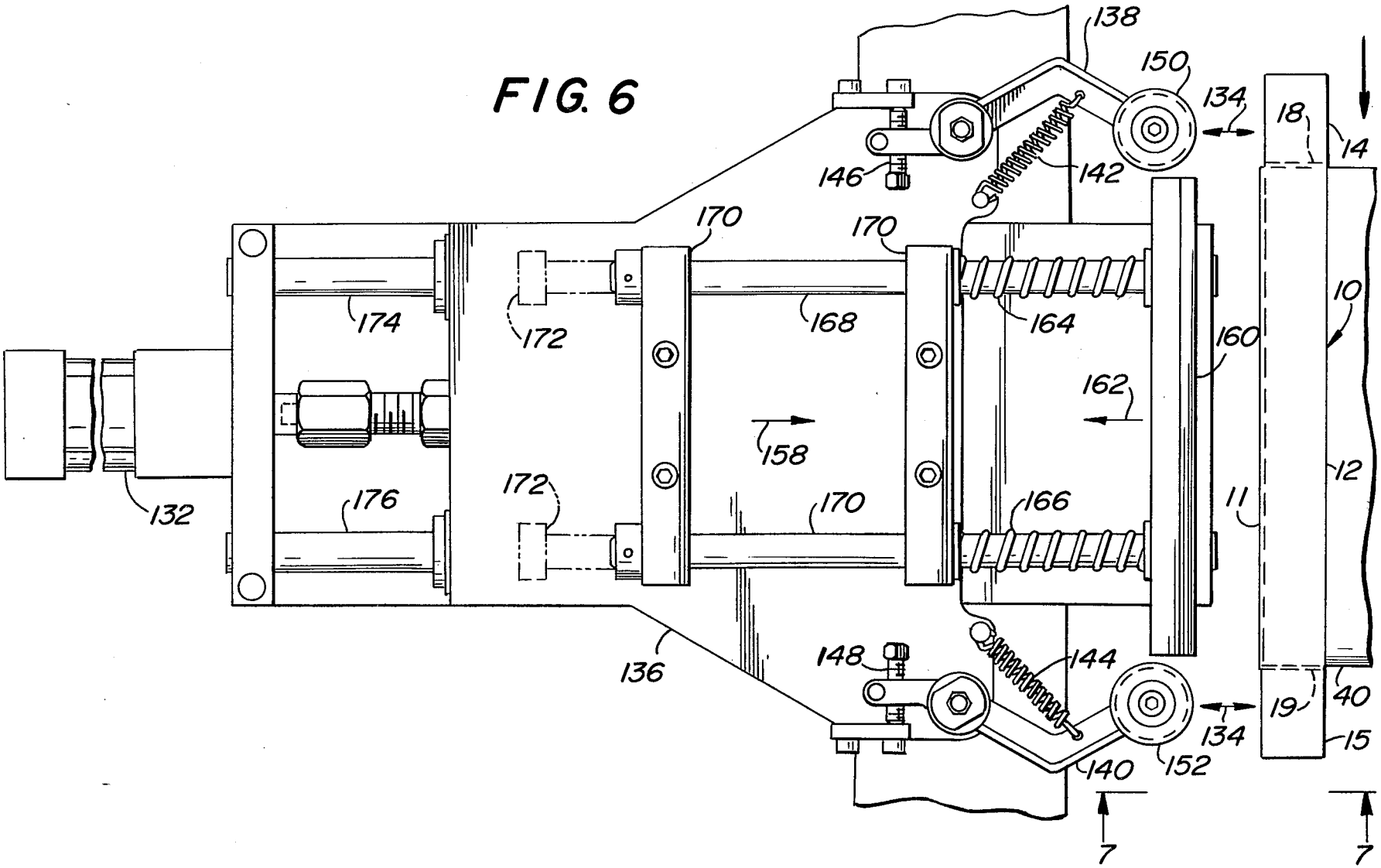
FIG. 6 is a plan view of the tuck station apparatus for folding the articulated end wall of the end cap along the longitudinal edges when the end cap is provided with such end walls.
Figure 7:
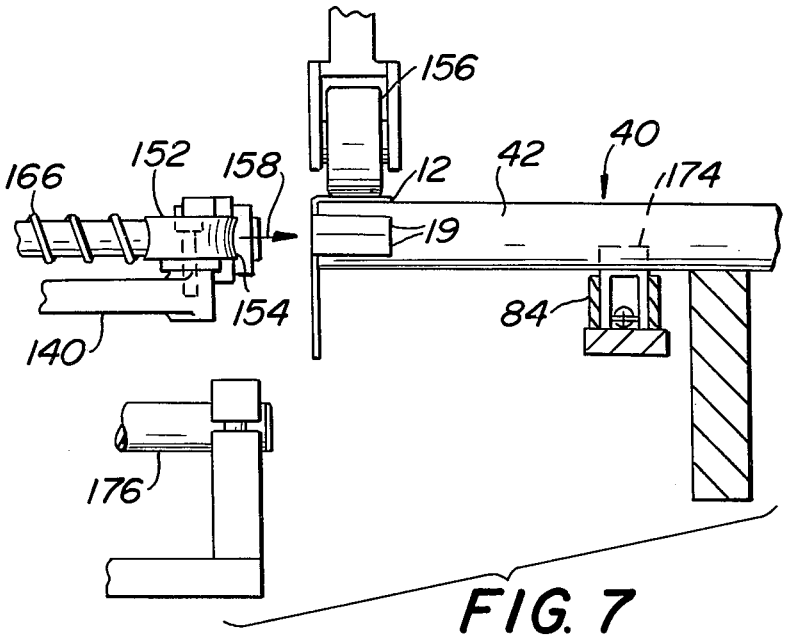
FIG. 7 is a side elevation view taken along line 7—7 of FIG. 6.

Cloth board reel 40 is then transported to tuck station 130. Tuck station 130 is unnecessary and may be eliminated where end caps 10 are not provided with articulated end walls 18 and 19. In other words, where end caps 10 are similar to those shown in FIG. 2 in applicant's co-pending application referred to above, tuck station 130 is unnecessary. A plan view of tuck station 130 is shown in FIG. 6. Tuck station assembly 130 is driven by pneumatic cylinder 132 to reciprocate in the direction of double headed arrows 134 in order to tuck down or fold over articulated end walls 18 and 19 along the arcuate longitudinal edges of reel 40. Pneumatic cylinder 132 drives tuck assembly carriage 136 in the directions of double headed arrows 134. Tuck assembly carriage 136 is provided with a pair of spring loaded roller arms 138 and 140. Spring loaded roller arms 138 and 140 are spring biased inwardly with each other to apply pressure to fold articulated end walls 18 and 19 over against the longitudinal edges of reel 40 by means of springs 142 and 144, respectively. Spring loaded roller arms 138 and 140 are provided with adjustable stops 146 and 148 respectively, to adjust roller arms 138 and 140 sufficiently outward to prevent interference between the rollers and the end of reel 40. Spring loaded roller arms 138 and 140 are provided with rollers 150 and 152, respectively, for which have an arcuately formed periphery, as may be better seen in FIG. 7, which substantially conforms to the arcuate shape of the longitudinal edge 42 of reel 40. The contoured arcuate surface 154 of roller 152 provides a closer and better application of the articulated end wall 19 to the arcuate shaped longitudinal edge 42 of the reel 40 thereby assuring better adhesive bonding and a final shape of the applied end cap conforming to that of the reel. As shown in FIG. 7, side wall 12 may be retained on the upper broad surface of reel 40 by means of a roller 156.

As tuck assembly carriage 136 is moved in the direction of arrow 158, spring loaded pad 160 comes in contact with face 11 of end cap 10 which had been previously folded over by folding taper roller 124. As carriage 136 continues to move in the direction of arrow 158, rollers 150 and 152 cause end walls 18 and 19 to be folded over as shown in FIG. 6. As carriage 136 continues to move in the direction of arrow 158, with spring loaded pad 160 in contact with front wall 11 on the end of reel 40, spring loaded pad 160 moves in the direction of arrow 162 against the spring bias provided by springs 164 and 166, with supporting bars 168 and 170 sliding in frame 170 as shown in dotted outline form at 172. Spring loaded pad 160 provides support to the end cap and particularly front wall 11 to prevent it from coming back off or out when rollers 150 and 152 are withdrawn. Carriage 136 rides on a pair of slide bars 174 and 176 which are supported by the frame of the apparatus.

After carriage 136 is withdrawn to the position as shown in FIG. 7, after end walls 18 and 19 are tucked in, cloth board reel 40 is moved by transport means 72 and spring loaded pusher 174 to wrap around station 176. The end walls 18 and 19 have been previously tucked in as shown in FIG. 1C. At wrap around station 176, extensions 14 and 15 are wrapped around the longitudinal edges of reel 40 as shown in FIG. 1D. Wrap around station 176 is shown in FIGS. 2, 8, 9 and 10.

Wrap around station 176 is operated by pneumatic cylinder 178. Pneumatic cylinder 178 drives frame 180 via connecting rod 182. Frame 180 rides on vertical supporting slide bars 184. Spring biased roller arms 186 and 188 are pivotally mounted to frame 180 at 190 and 192, respectively. Arm 186 is spring biased against adjustable stop 194 by spring 196. Spring biased roller arm 188 is spring biased against adjustable stop 198 by spring 200.

The lower end of spring biased roller arms 186 and 188 have pivotally connected thereto roller cluster plates 202 and 204 respectively. Roller cluster plate 202 is pivotally mounted to spring biased roller arm 186 at 206 and has roller 208, 209 and 210 mounted thereon. Roller cluster plate 204 is pivotally mounted to roller arm 188 at 212 and it has rollers 214, 215 and 216 mounted thereon in an arcuate path. Rollers 208 through 210 on plate 202 and rollers 214 through 216 on plate 204 are mounted in an arcuate path corresponding to the arcuate shape of the longitudinal edge of reel 40 as may be seen in FIG. 9.

Plates 202 and 204 are spring biased against stops 218 and 220, respectively. As may be seen in greater detail in the cross-sectional view in FIG. 10, torque spring 222 is mounted between roller arm 188 at point 224 and clamp 226 connected with pivot pin 212 of roller cluster plate 204.

Figure 9:
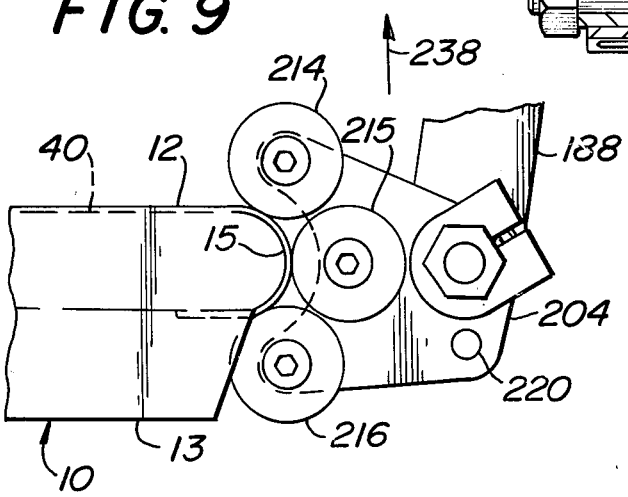
FIG. 9 is a side elevation view illustrating the roller plate with the rollers thereon in the position where the extension is wrapped around the longitudinal edge.
Figure 10:
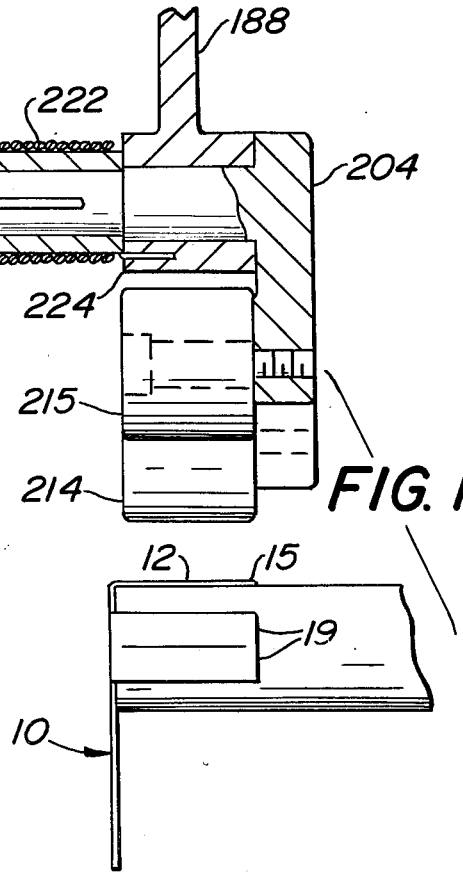
FIG. 10 is a cross-sectional view taken along line 10—10 of FIG. 8.
Figure 8:
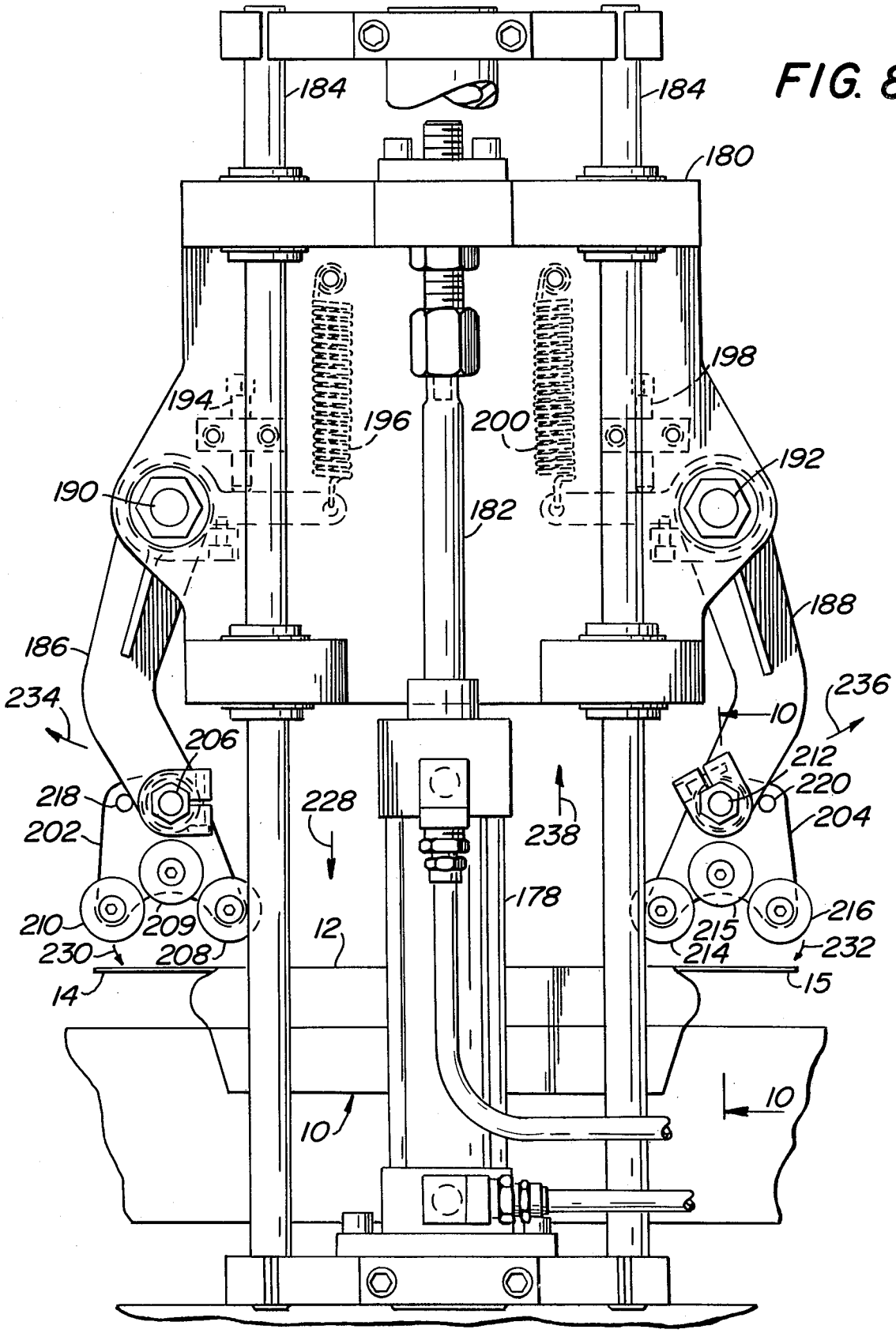
FIG. 8 is an exploded elevation view of the structure of the apparatus for wrapping the extensions of the side wall around the longitudinal edges of the reel.

As frame 180 is drawn downward by pneumatic cylinder 178 and connecting rod 182, roller arm 186 and 188, along with roller plates 202 and 204 are carried downwardly in the direction of arrow 228. As frame 180 continues to move downwardly, rollers 208 and 214 contact sidewall 12 at the beginning of extensions 14 and 15, respectively, of end cap 10. As frame 180 continues to be drawn downwardly in the direction of arrow 228, cluster plates 202 and 204 to pivot on their pivot points 206 and 212, respectively against the tension of their respective torque springs. Plates 202 and 204 pivot in the direction of arrows 230 and 232, respectively. This motion also causes arms 186 and 188 to pivot on their respective pivot points 190 and 192 in the direction of arrows 234 and 236, respectively. As the downward motion continues, roller plate 204, with rollers 214, 215 and 216 assume the position as shown in FIG. 9 wherein extension 15 of sidewall 12 is wrapped around the longitudinal edge of cloth board reel 40. The three rollers are mounted on plates in an arcuate path corresponding to the shape of the longitudinal edge of reel 40 and provide a smooth continuous wrapping of the extension about the longitudinal edge. The use of the three rollers in this manner prevents the roller assembly, that is the rollers and the roller cluster plate, from becoming locked on the edge of the reel preventing or hindering the return of frame 180 in the direction of arrow 238. It is understood throughout that the recitation of directions of movement, such as upward and downward, are a description of the preferred arrangement of the invention, but are not intended to be limiting, and it is expressly understood that these movements could be in other directions, such as horizontal, with appropriate modifications. The important concepts lie in the movement of the apparatus with respect to the application of the end cap to the reel.

After extensions 14 and 15 of side wall 12 have been wrapped around the longitudinal edges of the reel at wrap around station 176, as shown in FIG. 1D, reel 40 is transported by transport means 72 past horizontally mounted folding taper roller 240 which folds underneath lower side wall 13 over the ends of extensions 14 and 15 and onto the lower broad surface of reel 40. Taper roller 240 is similar to taper roller 124 except that it is mounted in a different plane. As side wall 13 comes in contact with taper roller 240, it is folded underneath reel 40 onto the edge and is bonded thereto by the hot melt adhesive which had been sprayed thereon at hot melt adhesive application station 98. It is understood that taper rollers 124 and 240 need not compise separate stations, but may be mounted as folding taper rollers in between stations thereby shortening the length of the overall apparatus.

Figure 1E:
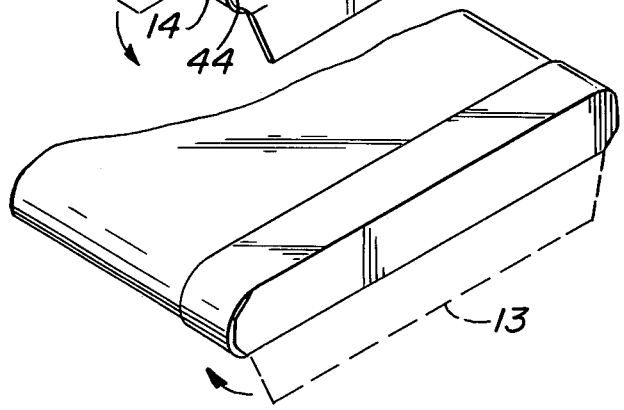

After side wall 13 has been folded under as shown in FIG. 1E, the reel with the end cap thereon is transported by transport means 72 to a stacking means 242 in which the reels may be stacked in pre-determined numbers automatically. However, any suitable means of removing the reels from the end of the apparatus may be used.

In view of the above, the present invention may be embodiend in other specific forms without departing from the spirit or essential attributes thereof and, accordingly, reference should be made to the appended claims, rather than to the foregoing specification as indicating the scope of the invention.

I claim:

1. An apparatus for applying an end cap to a cloth board reel, said end cap being provided with a front wall and a pair of articulated sidewalls, one of said side walls having a sidewall extension at each end, wherein said sidewall extensions are to be wrapped around the longitudinal edges of said reel for bonding thereto, comprising:

means for transporting a reel through the apparatus;

means for applying adhesive to at least one of the surfaces to be bonded; and means for wrapping a sidewall extension on each side of said end cap around the longitudinal edge of said reel, said wrapping means including a frame having pivotally mounted thereto a pair of spaced roller mechanisms, each of said roller mechanisms being comprised of three rollers arranged in an arcuate path, said frame being movable towards the reel with the pivotally mounted roller mechanisms being caused to rotate around the longitudinal edge of the reel when one of the rollers comes in contact with the reel thereby causing the extension of each sidewall to be wrapped around and bonded to said reel.

2. An apparatus in accordance with claim 1 wherein said roller mechanism includes three rollers mounted in an arcuate path conforming to a rounded longitudinal edge of the reel.

3. An apparatus in accordance with claim 1 wherein said roller mechanism includes a roller arm pivotally mounted to said frame and resiliently biased to provide an inward pressure, and a roller plate with three rollers thereon mounted in an arcuate path, said roller plate being pivotally mounted to the opposite end of said roller arm and resiliently biased to a position releasing said rollers from the reel.

4. An apparatus in accordance with claim 1 wherein the end caps to be mounted to the reel include articulated end walls at each end of the front wall, a tuck station being provided at a point along the path of travel of the transport means prior to said wrapping means, said tuck means including a reciprocating frame having pivotally mounted thereon a pair of roller arms resiliently biased to fold said end walls over the longitudinal edge of said reel.

5. An apparatus in accordance with claim 4 wherein said tuck rollers are provided with a periphery conforming to the shape of the longitudinal edge of the reel.

6. An apparatus in accordance with claim 1 wherein said means for applying adhesive to at least one of the surfaces to be bonded is comprised of a spray applicator for spraying hot melt adhesive to the surface of the reel to be bonded.

7. An apparatus for applying an end cap to a cloth board reel, said end cap being provided with a front wall and a pair of articulated side walls, one of said side walls having a side wall extension at each end, comprising:

means for transporting reels in a step-wise fashion from station to station through the apparatus;

means for applying a hot melt adhesive to surfaces to be bonded about the periphery of the reel near its end and on the end face of the reels;

means for applying the side wall having extensions to a broad surface of the reel having hot melt adhesive previously applied thereto;

means for folding the front wall of the end cap onto the end face of the reel where adhesive has been previously applied;

means for wrapping the side wall extensions on each side of said end cap around the longitudinal edges of said reel wherein they become bonded to said reel, said wrapping means including a frame having pivotally mounted thereto a pair of spaced roller mechanisms, each of said roller mechanisms being comprised of three rollers arranged in an arcuate path, said frame being movable towards the reel with the pivotally mounted roller mechanisms being caused to wrap said extensions about the longitudinal edges of the reel wherein said extensions become bonded to said reel; and means for folding the second side wall onto the second broad surface of said reel wherein it becomes bonded to said reel and overlaps the ends of said extensions.

8. An apparatus in accordance with claim 7 wherein said transport means includes a reciprocating beam having spring loaded pushers mounted thereon for engaging the reels to be transported, said spring loaded pushers being retractable into said reciprocating beam on the return motion.

9. An apparatus in accordance with claim 7 wherein said end caps are applied by a reciprocating feed arm from the bottom of a hopper, said reels being pushed into engagement with the side wall of the end cap as delivered by the feed arm.

10. An apparatus in accordance with claim 9 wherein said feed arm is slotted.

11. An apparatus in accordance with claim 7 wherein the said means for folding over said front wall is a roller having a tapered circumference which engages said front wall.

12. An appartus in accordance with claim 7 wherein said roller mechanism includes three rollers mounted in an arcuate path conforming to the shape of the rounded longitudinal edge of the reel.

13. An apparatus in accordance with claim 7 wherein said roller mechanism includes a roller arm pivotally mounted to said frame and resiliently biased to provide an inward pressure, and a roller plate being pivotally mounted to the opposite end of said roller arm and resiliently biased with respect to said roller arm.

14. An apparatus in accordance with claim 13 wherein said roller plate is pivotally biased so that the first and last rollers are biased in a substantially horizontal plane.

15. An apparatus in accordance with claim 7 wherein the end caps to be mounted to the reel include articulated end walls at each end of the front wall, a tuck station being provided at a point along the path of travel of the transport means prior to said wrapping means, said tuck means including a reciprocating frame having pivotally mounted thereon a pair of roller arms resiliently biased to fold said end walls over the longitudinal edge of said reel.

16. An apparatus in accordance with claim 7 wherein said tuck rolls are provided with a periphery shape to conform to the shape of the longitudinal edge.

17. An apparatus in accordance with claim 7 wherein said means for applying hot melt adhesive is comprised of a spray applicator.

* * * * *